US011149922B1

(12) United States Patent
Reyes

(10) Patent No.: US 11,149,922 B1
(45) Date of Patent: Oct. 19, 2021

(54) LIGHT OUTPUT REDUCING SHUTTER SYSTEM

(71) Applicant: Eduardo Reyes, Miami, FL (US)

(72) Inventor: Eduardo Reyes, Miami, FL (US)

( * ) Notice: Subject to any disclaimer, the term of this patent is extended or adjusted under 35 U.S.C. 154(b) by 0 days.

(21) Appl. No.: 17/232,233

(22) Filed: Apr. 16, 2021

(51) Int. Cl.

| | |
|---|---|
| ***F21V 11/06*** | (2006.01) |
| ***F21V 14/08*** | (2006.01) |
| ***F21S 10/00*** | (2006.01) |
| ***F21V 11/18*** | (2006.01) |
| ***F21S 8/04*** | (2006.01) |
| *F21W 131/406* | (2006.01) |

(52) U.S. Cl.
CPC ..... *F21V 11/065* (2013.01); *F21S 10/007* (2013.01); *F21V 11/18* (2013.01); *F21V 14/08* (2013.01); *F21S 8/043* (2013.01); *F21W 2131/406* (2013.01)

(58) Field of Classification Search
CPC ..... F21V 11/18–186; F21V 11/06; F21V 11/065; F21V 14/08–085; F21S 10/007; F21W 2131/406
See application file for complete search history.

(56) References Cited

U.S. PATENT DOCUMENTS

| | | | |
|---|---|---|---|
| 4,210,955 A | 7/1980 | Labrum | |
| 4,458,303 A | 7/1984 | Berns | |
| 5,904,417 A | 5/1999 | Hewett | |
| 6,126,288 A | 10/2000 | Hewlett | |
| 6,334,699 B1 | 1/2002 | Gladnick | |
| 6,550,939 B2 | 4/2003 | Reinert | |
| 7,108,401 B1 * | 9/2006 | Kane | F21V 11/18 362/281 |
| 7,572,035 B2 | 8/2009 | Hewlett | |
| 7,736,025 B2 | 6/2010 | Hofmann et al. | |
| 8,616,731 B2 | 12/2013 | Quadri et al. | |
| 8,757,817 B2 | 6/2014 | Hewlett et al. | |
| 8,911,120 B2 | 12/2014 | Dalsgaard et al. | |
| 9,121,575 B2 | 9/2015 | Quadri et al. | |
| 9,204,121 B1 | 12/2015 | Marason et al. | |
| 9,507,072 B2 | 11/2016 | Wakui et al. | |
| 9,664,361 B2 | 5/2017 | Hansen | |

(Continued)

FOREIGN PATENT DOCUMENTS

| | | | |
|---|---|---|---|
| FR | 2838808 A1 * | 10/2003 | F21S 10/007 |
| GB | 340565 A | 1/1931 | |
| WO | WO-2008150288 A1 * | 12/2008 | F21V 21/30 |

*Primary Examiner* — Mariceli Santiago
(74) *Attorney, Agent, or Firm* — Albert Bordos, P. A.

(57) ABSTRACT

A light output reducing shutter system, having a light system with a shutter barrel assembly, a solid shutter assembly, a first translucent shutter assembly, and a second translucent shutter assembly, wherein the solid shutter assembly, the first translucent shutter assembly, and the second translucent shutter assembly are positioned in a same focal plane when a light is projected from the light system. The first translucent shutter assembly has a first degree of translucency and the second translucent shutter assembly has a second degree of translucency. The shutter barrel assembly has a first set of slots, a second set of slots, and a third set of slots to receive the solid shutter assembly, the first translucent shutter assembly, and the second translucent shutter assembly respectively. The first set of slots, the second set of slots, and the third set of slots each have four slots around the shutter barrel assembly.

20 Claims, 9 Drawing Sheets

(56) References Cited

U.S. PATENT DOCUMENTS

| | | | | |
|---|---|---|---|---|
| 9,784,436 | B2 | 10/2017 | Dalsgaard et al. | |
| 9,979,953 | B1 | 5/2018 | Marason et al. | |
| 9,989,217 | B2 | 6/2018 | Jurik et al. | |
| 10,077,885 | B2 | 9/2018 | Hansen | |
| 10,386,030 | B2 | 8/2019 | Campetella | |
| 2003/0048640 | A1* | 3/2003 | Reinert | F21V 11/18 362/321 |
| 2012/0300464 | A1* | 11/2012 | Sell | F21V 17/162 362/281 |
| 2021/0250562 | A1* | 8/2021 | Moon | G03B 21/2033 |

* cited by examiner

LIGHT OUTPUT REDUCING SHUTTER SYSTEM

BACKGROUND OF THE INVENTION

1. Field of the Invention

The present invention relates to lighting systems, and more particularly, to light output reducing shutter systems combining standard solid shutters with translucent shutters.

2. Description of the Related Art

Applicant believes that one of the closest references corresponds to U.S. Pat. No. 10,077,885 B2 issued to Hansen on Sep. 18, 2018 for Iris diaphragm system. However, it differs from the present invention because Hansen teaches an iris diaphragm that comprises a stationary ring, a rotatable adjusting ring, and a plurality of shutter blades. The plurality of shutter blades forms a diaphragm aperture inside the stationary ring and rotation of the adjusting ring moves the shutter blades inside the stationary ring, whereby the size of the diaphragm aperture can be changed. The shutter blades are formed as a flat opaque surface and at least one of the shutter blades comprises at least one transparent region formed in said opaque surface. A light fixture comprises such iris diaphragm arranged between a light source generating a light beam and an optical assembly configured to project the light beam along an optical axis.

Applicant believes that another reference corresponds to U.S. Pat. No. 9,507,072 B2 issued to Wakui, et al. on Nov. 29, 2016 for Light guide, manufacturing method of light guide, optical shutter, and planar light-source device. However, it differs from the present invention because Wakui, et al. teach a plate-type light guide in which two opposing main surfaces are set as light emitting surfaces and at least one side-edge surface is set as a light incidence surface. In such a light guide, a light emitting mechanism is provided in at least one region of at least one main surface; the haze value is 3% or lower in the region where the light emitting mechanism is provided; when a perfect diffuse light enters through at least one light incidence surface, a maximum emission angle, at which maximizes the intensity of emitted light from the main surface is in a range from −60 degrees to +60 degrees with respect to a normal line to the main surface; and the utilization efficiency of emitted light is 15% or greater.

Applicant believes that another reference corresponds to U.S. Pat. No. 6,550,939 B2 issued to Travis J. Reinert on Apr. 22, 2003 for Light beam shutter apparatus. However, it differs from the present invention because Reinert teaches a light beam shutter apparatus for a lighting instrument that includes several individual shutter mechanisms arranged radially around the axis of a light beam. Each shutter mechanism includes a generally circular shutter blade having a circumference, but with a cut-out or void area such that a portion of the circumference is eliminated. The shutter blade preferably includes at least one straight edge at the boundary of the cut-out or void area, which straight edge passes through the center around, which the shutter blade rotates, and is used for intercepting at least a portion of a light beam passing through the light beam shutter apparatus. The shutter blade may alternatively include other edge shapes at the boundary of the cut-out or void area, as desired. Driven surfaces, such as gear teeth or the like, are formed in opposed portions of the remaining circumference. The shutter blade is mechanically coupled to linear driving members, such as rack gears or the like, which are driven in turn by rotary driving members, such as pinions or the like.

Applicant believes that another reference corresponds to U.S. Pat. No. 4,210,955 A issued to Joseph H. Labrum on Jul. 1, 1980 for Shutter system for stage-lighting spotlights. However, it differs from the present invention because Labrum teaches a shutter system for stage lighting spotlights that includes a housing having a fixed framing gate therein, which has an opening therethrough for the passage of light. Two sets of opposing shutter blades are sandwiched, one on each side of the framing gate, between the framing gate and one of a pair of pressure plates which have means urging them toward the framing gate. Each shutter blade has a neck portion which extends through a slot in the housing and which serves as a handle to which pressure may be applied to move the shutter blade. The blades are normally held in place by the action of the pressure plates against the blades and framing gate.

Applicant believes that another reference corresponds to U.S. Pat. No. 8,757,817 B2 issued to Hewlett, et al. on Jun. 24, 2014 for Illumination obscurement device with two separate light cell arrays that produces a shaped beam of light as output. However, it differs from the present invention because Hewlett, et al. teach an illumination obscurement device for controlling the obscurement of illumination from a light source, which is optimized for use with a rectangular, arrayed, selective reflection device. A rotatable shutter with three positions is placed between a light source and a DMD. The first position of the shutter is a mask, preferably an out of focus circle. This out of focus circle creates a circular mask and changes any unwanted dim reflection to a circular shape. The second position of the shutter is completely open, allowing substantially all the light to pass. The third position of the shutter is completely closed, blocking substantially all the light from passing. By controlling the penumbra illumination surrounding the desired illumination, DMDs can be used in illumination devices without creating undesirable rectangular penumbras.

Applicant believes that another reference corresponds to U.S. Pat. No. 7,572,035 B2 issued to William E. Hewlett on Aug. 11, 2009 for illumination obscurement device. However, it differs from the present invention because Hewlett teaches an illumination obscurement device for controlling the obscurement of illumination from a light source, which is optimized for use with a rectangular, arrayed, selective reflection device. a rotatable shutter with three positions is placed between a light source and a DMD. The first position of the shutter is a mask, preferably an out of focus circle. This out of focus circle creates a circular mask and changes any unwanted dim reflection to a circular shape. The second position of the shutter is completely open, allowing substantially all the light to pass. The third position of the shutter is completely closed, blocking substantially all the light from passing. By controlling the penumbra illumination surrounding the desired illumination, DMDs can be used in illumination devices without creating undesirable rectangular penumbras.

Applicant believes that another reference corresponds to U.S. Pat. No. 9,979,953 B1 issued to Marason, et al. on May 22, 2018 for Reflector-based depth mapping of a scene. However, it differs from the present invention because Marason, et al. teach a system to determine depth of one or more objects within a scene that includes a single light source, a reflector (e.g., an ellipsoidal reflector), a shutter mechanism associated with the light source, and a camera. The light source may output light that is directed towards the scene (a first set of light beams) and towards the reflector (a second set of light beams) utilizing the shutter mechanism. The reflector may reflect the second set of light beams towards the scene. The camera may then capture a first image that corresponds to the first set of light beams and a second image that corresponds to the second set of light beams. The depth of a particular one of the objects within the scene may be determined based at least in part on the first image and the second image.

Applicant believes that another reference corresponds to U.S. Pat. No. 9,204,121 B1 issued to Marason, et al. on Dec. 1, 2015 for Reflector-based depth mapping of a scene. However, it differs from the present invention because Marason, et al. teach system to determine a depth of one or more objects within a scene that includes a single light source, a reflector (e.g., an ellipsoidal reflector), a shutter mechanism associated with the light source, and a camera. More particularly, the light source may output light that is directed towards the scene (a first set of light beams) and towards the reflector (a second set of light beams) utilizing the shutter mechanism. The reflector may reflect the second set of light beams towards the scene. The camera may then capture a first image that corresponds to the first set of light beams and a second image that corresponds to the second set of light beams. The depth of a particular one of the objects within the scene may be determined based at least in part on the first image and the second image.

Applicant believes that another reference corresponds to U.S. Pat. No. 5,904,417 A issued to Arthur Hewett on May 18, 1999 for Light fixture with elliptical reflector and mechanical shutter dimmer. However, it differs from the present invention because Hewett teaches a lighting apparatus including a discharge arc lamp illumination source, an elliptical reflector completely surrounding the illumination source for collecting and projecting light from the illumination source, a shutter for dimming the amount of light generated by the illumination source and emanating from the lighting apparatus. The shutter is mechanically operable to define an optical passageway therethrough of variable cross sectional area. The shutter includes a plurality of shutter blades mounted in a movable relationship relative to each other in response to user input. The shutter blades is movable to define the optical passageway of variable cross sectional area to dim the amount of light from the illumination source passing therethrough over the range of from about 0 to 100%.

Applicant believes that another reference corresponds to U.S. Pat. No. 7,736,025 B2 issued to Hofmann, et al. on Jun. 15, 2010 for Illumination system comprising mechanical dimming device. However, it differs from the present invention because Hofmann, et al. teach an illumination system, comprising an illumination source and a mechanical dimming device for dimming the amount of light generated by the illumination source and emanating from the lighting apparatus, comprising an array of partially overlapping blades, the array of blades being mechanically operable to define an optical passageway there through of variable cross sectional area, wherein each blade comprises at least one overlapping segment and at least one non-overlapping segment, the overlapping segments being a color filter and the non-overlapping segments being a shutter. In a preferred embodiment the color of the color filter is in the range from yellow to amber to red. This arrangement is especially useful with a high intensity lamp as the illumination source, and provides for natural dimming of the light produced by the illumination source over the range of from about 0 to 100% causing a color change in the projected light that resemble natural sunset.

Applicant believes that another reference corresponds to U.S. Pat. No. 9,121,575 B2 issued to Quadri, et al. on Sep. 1, 2015 for Stage light fixture. However, it differs from the present invention because Quadri, et al. teach a stage light fixture with a light source adapted to emit a light beam along an optical axis, and a color filter assembly comprising a plurality of color filters rotating about a same first axis of rotation, the first axis of rotation being parallel to the optical axis and not coincident with the optical axis.

Applicant believes that another reference corresponds to U.S. Pat. No. 8,616,731 B2 issued to Quadri, et al. on Dec. 31, 2013 for Stage light fixture and light fixture assembly comprising said stage light fixture. However, it differs from the present invention because Quadri, et al. teach a stage light fixture with a main body extending along a longitudinal axis and having an outer surface; a light source arranged inside the main body at a first end of the main body and suitable to emit a light beam substantially along the axis; and with an objective lens arranged at a second end of the main body; the main body is provided with a plurality of inserts to fix to the outer surface, by means of a magnetic coupling, a filter suitable to intercept the light beam which crosses the objective lens; the inserts are made of a magnetic material and/or of a metallic material suitable to be attracted by a magnetic material.

Applicant believes that another reference corresponds to U.S. Pat. No. 9,784,436 B2 issued to Dalsgaard, et al. on Oct. 10, 2017 for Light beam framing system with merged shutter blades. However, it differs from the present invention because Dalsgaard, et al. teach a framing system for shaping light beam that comprises a frame support having a number of shutter blades surrounding the light beam, and a number of actuators that move the shutter blades in and out of the light beam. The shutter blades form a merged pile, where part of a first shutter blade is placed over a part of a second shutter blade. A first actuator rotates at least one of the shutter blades in relation to a first rotational point and a second actuator moves the first rotational point in relation to said light beam. A method of shaping a light beam is provided, and involves rotating a shutter blade around a first rotation point using a first actuator, and moving the first rotation point in relation to the light beam using a second actuator.

Applicant believes that another reference corresponds to U.S. Pat. No. 9,989,217 B2 issued to Jurik, et al. on Jun. 5, 2018 for Beam framing system for an automated luminaire. However, it differs from the present invention because Jurik, et al. teach an automated luminaire and automated luminaire system with both a spot light and wash light mode of operation, which employs an improved beam shutter blade system that serves as framing shutters in spot light mode and barn doors in wash light mode.

Applicant believes that another reference corresponds to U.S. Pat. No. 8,911,120 B2 issued to Dalsgaard, et al. on Dec. 16, 2014 for Light beam framing system with merged shutter blades. However, it differs from the present invention because Dalsgaard, et al. teach a framing system for shaping a light beam. The framing system comprises a frame support comprising a number of shutter blades surrounding said light beam and a number of actuators adapted to move said shutter blades in and out of said light beam. The shutter blades form a merged pile, where part of a first shutter blade is in placed over a part of a second shutter blade and where another part is placed below a part of a third shutter blade. A first actuator rotates at least one of the shutter blades in relation to a first rotational point and a second actuator moves the first rotational point in relation to said light beam.

Applicant believes that another reference corresponds to U.S. Pat. No. 6,334,699 B1 issued to Gladnick on Jan. 1, 2002 for Systems and methods for diffuse illumination. However, it differs from the present invention because Gladnick teaches a light pattern controller that provides a pattern of light to a collimator. The light pattern controller includes a beam deflector that sweeps a circular pattern with a radius that is directly proportional to the rotational speed of the beam deflector. Alternatively, the light pattern controller includes a two-dimensional scanning galvanometer that sweeps out the circular pattern or a liquid crystal shutter. The pattern of light is collimated and reflected such that it is substantially parallel to the optical axis of an imaging system. A focusing element redirects the collimated light pattern onto a sample part at an angle of incidence, which is a function of the radius of the light column.

Applicant believes that another reference corresponds to U.S. Pat. No. 9,664,361 B2 issued to Hansen on May 30, 2017 for Light effect system for forming a light beam. However, it differs from the present invention because Hansen teaches a light effect system for forming a light beam. The light effect system comprises a first light forming means adapted to form at least a part of the light beam where at least a first actuator is adapted to rotate the first light forming means around a first rotational point and around an first axis substantially parallel to the central axis of the light beam. At least a second actuator is adapted to move the first light forming means in relation to the light beam, such that first rotational point is moved in an area outside the light beam and radially in relation to the central axis of the light beam.

Applicant believes that another reference corresponds to U.S. Pat. No. 10,386,030 B2 issued to Francesco Campetella on Aug. 20, 2019 for Light fixture, preferably for stage. However, it differs from the present invention because Campetella teaches a light fixture, preferably for stage, which includes a source assembly, configured to emit at least one light beam along an emission direction and a mixing assembly arranged downstream of the source assembly along the emission direction and being configured to mix at least one light beam emitted by the source assembly. The light fixture further includes a color assembly comprising at least one color device configured to selectively color the light beam passing through it. The color assembly is arranged between the source assembly and the mixing assembly.

Applicant believes that another reference corresponds to U.S. Pat. No. 4,458,303 A issued to Berns on Jul. 3, 1984 for Light beam concentrating, intensifying and filtering device. However, it differs from the present invention because Berns teaches a light beam concentrating, intensifying and filtering device for use in combination with a parallel ray light source comprising a frame having a plurality of shutter leaves capable of opening and closing an aperture when actuated. Each shutter leaf is comprised of a colorless or coloured transparent portion and a portion that is coated on its inner surface with a reflective material.

Applicant believes that another reference corresponds to U.S. Pat. No. 6,126,288 A issued to William E. Hewlett on Oct. 3, 2000 for Programmable light beam shape altering device using programmable micro mirrors. However, it differs from the present invention because Hewlett teaches a digital micro mirror device used to alter the shape of light that is projected onto a stage. The DMD selectively reflects some light, thereby shaping the light that is projected onto the stage. The control for the alteration is controlled by an image. That image can be processed, thereby carrying out image processing effects on the shape of the light that is displayed. One preferred application follows the shape of the performer and illuminates the performer using a shape that adaptively follows the performer's image. This results in a shadow less follow spot.

Applicant believes that another reference corresponds to GB Patent No. 340,565 issued to Zug Hofstrasse on Jan. 2, 1931 for an improved method of and apparatus for illumination with a continuous play of colors. However, it differs from the present invention because Hofstrasse teaches a system of colour lighting a series of differently coloured lights successively emitted, the transition from one colour to the next being effected below the maximum intensity of the successive lights, and during the change of colour there is additional illumination with white light. The intensity of the white supplementary light may be regulated to increase from an initial value up to a maximum value and then decrease to a final value, and its duration may be shorter than that of the successive coloured lights.

Other patents describing the closest subject matter provide for a number of more or less complicated features that fail to solve the problem in an efficient and economical way. None of these patents suggest the novel features of the present invention. Particularly that the present invention modifies existing technologies by adding translucent shutters of different degrees of transparencies to reduce light in a selected area as opposed to existing shutters that currently eliminates light from a selected area.

SUMMARY OF THE INVENTION

The present invention is a light output reducing shutter system, comprising a light system having a shutter barrel assembly, a solid shutter assembly, a first translucent shutter assembly, and a second translucent shutter assembly, wherein the solid shutter assembly, the first translucent shutter assembly, and the second translucent shutter assembly are positioned in a same focal plane when a light is projected from the light system.

The first translucent shutter assembly comprises a first degree of translucency and the second translucent shutter assembly comprises a second degree of translucency. The shutter barrel assembly comprises a first set of slots, a second set of slots, and a third set of slots to receive the solid shutter assembly, the first translucent shutter assembly, and the second translucent shutter assembly respectively. The first set of slots, the second set of slots, and the third set of slots each comprise four slots around the shutter barrel assembly.

The solid shutter assembly comprises a top solid shutter blade, a bottom solid shutter blade, first and second lateral solid shutter blades, and at least two plates. The top solid shutter blade, the bottom solid shutter blade, and the first and second lateral solid shutter blades comprise respective handles to be manually operated. In another embodiment, the top solid shutter blade, the bottom solid shutter blade, and the first and second lateral solid shutter blades are internally incorporated within the shutter barrel assembly to be controlled via a lighting controller device.

The first and second translucent shutter assemblies each comprise a top translucent shutter blade, a bottom translucent shutter blade, first and second lateral translucent shutter blades, and at least two plates. The top translucent shutter blades, the bottom translucent shutter blades, and the first and second lateral translucent shutter blades each comprise a respective handle to be manually operated. In another embodiment, the top translucent shutter blades, the bottom translucent shutter blades, and the first and second lateral translucent shutter blades are internally incorporated within the shutter barrel assembly to be controlled via a lighting controller device.

The top translucent shutter blades, the bottom translucent shutter blades, and the first and second lateral translucent shutter blades are used one at a time or in combination with one another. The top translucent shutter blades, the bottom translucent shutter blades, and the first and second laterals translucent shutter blades allow some light to pass through them. At least one of the first translucent shutter assembly and the second translucent shutter assembly is used in combination with the solid shutter assembly.

The first translucent shutter assembly and the second translucent shutter assembly reduce an intensity of the light projected from the light system. The first translucent shutter assembly and the second translucent shutter assembly reduce an output in part of a projected light field, thus reducing an output solely where the top translucent shutter blades, the bottom translucent shutter blades, the first lateral translucent shutter blades, and/or the second lateral translucent shutter blades enter the projected light field, while not dimming or reducing a light output of a remaining area of the projected light field.

The lighting system may also be an automated light system. The lighting system further comprises at least one gobo wheel fixed or rotatably mounted therein. The at least one gobo wheel is used independently or in combination with the solid shutter assembly and the first and second translucent shutter assemblies. The at least one gobo wheel comprises a plurality of gobo patterns, whereby the plurality of gobo patterns are solids and/or translucent.

It is therefore one of the main objects of the present invention to provide a light output reducing shutter system.

It is another object of this invention to provide a light output reducing shutter system, which has at least one additional translucent shutter assembly.

It is another object of this invention to provide a light output reducing shutter system, in which the translucent shutter assembly reduces the intensity of the light.

It is another object of this invention to provide a light output reducing shutter system in which the translucent shutter assembly allows some light to pass through respective shutters blades.

It is another object of this invention to provide a light output reducing shutter system in which the translucent shutter assemblies allow some light to pass through respective shutter blades with the same or different degree of translucency.

It is another object of this invention to provide a light output reducing shutter system, which further comprises gobos.

It is another object of this invention to provide a light output reducing shutter system that can be readily assembled and disassembled without the need of any special tools.

It is yet another object of this invention to provide a light output reducing shutter system that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
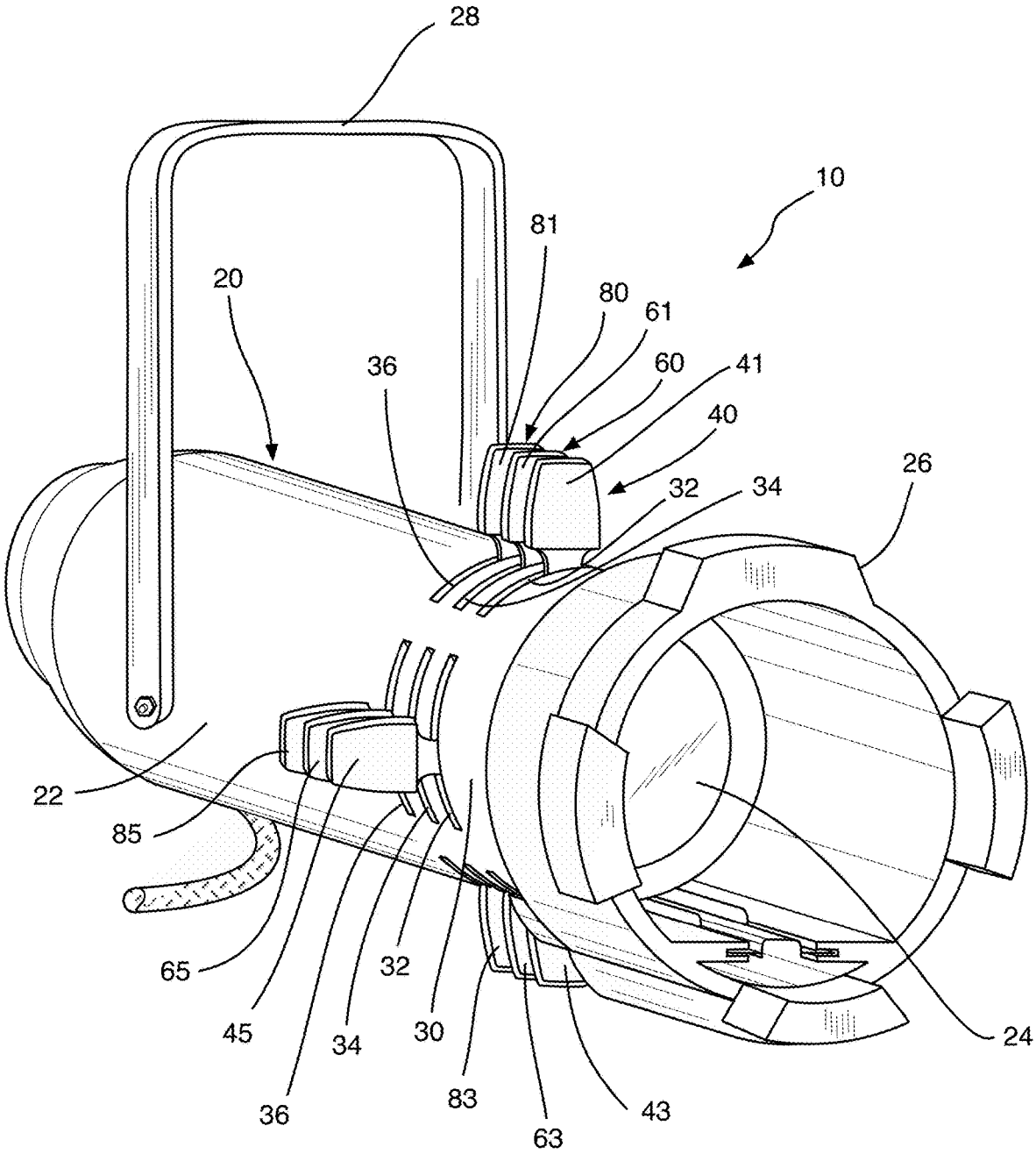
FIG. 1 is an isometric view of a first embodiment of the present invention mounted onto a lighting system.

Referring now to the drawings, the present invention is a light output reducing shutter system, and is generally referred to with numeral 10. It can be observed that it basically includes lighting system 20, solid shutter assembly 40, first translucent shutter assembly 60, and second translucent shutter assembly 80.

As seen in FIG. 1, lighting system 20 comprises housing 22, lens 24, color frame holder 26, yoke 28, and shutter barrel assembly 30. In a preferred embodiment, lighting system 20 is an ellipsoidal type light. Shutter barrel assembly 30 comprises solid shutter assembly 40, first translucent shutter assembly 60, and second translucent shutter assembly 80. Shutter barrel assembly 30 further comprises first set of slots 32, second set of slots 34, and third set of slots 36 to receive solid shutter assembly 40, first translucent shutter assembly 60, and second translucent shutter assembly 80 respectively. First set of slots 32, second set of slots 34, and third set of slots 36 each comprises four slots around shutter barrel assembly 30. In a preferred embodiment, each of the four slots around shutter barrel assembly 30 are equally distanced from each other. Solid shutter assembly 40, first translucent shutter assembly 60, and second translucent shutter assembly 80 are sufficiently close to each other to be in a same focal plane, so that their respective edges can be in a same focus range when a light is projected from light system 20.

In a first embodiment, first and second translucent shutter assemblies 60 and 80, in combination with solid shutter assembly 40, are used on light system 20 as a manual light system. In operation, at least one of first and second translucent shutter assemblies 60 and 80 is used in combination with solid shutter assembly 40. First translucent shutter assembly 60 and second translucent shutter assembly 80 are used to reduce an intensity of light projected from light system 20. Present invention 10 provides a new fixture or modification/redesign to lighting system 20. In a preferred embodiment, lighting system 20 may be a Colour 5 Profile, or similar lighting system for stages, theaters, television studios, television sets, and/or filming.

Figure 2:
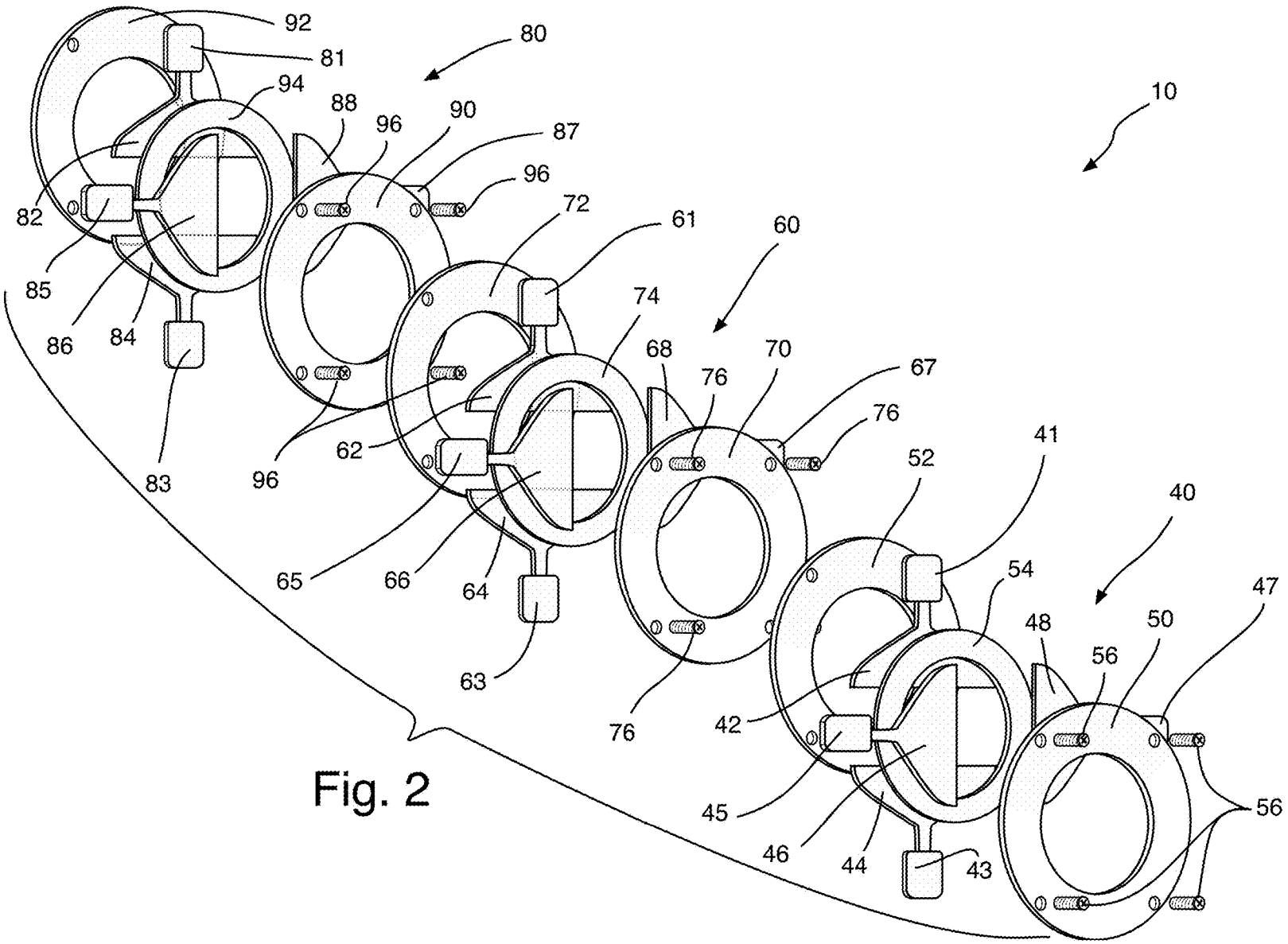
FIG. 2 is an exploded view of the first embodiment of the shutter assemblies of the present invention.

As seen in FIG. 2, solid shutter assembly 40 comprises top solid shutter blade 42, bottom solid shutter blade 44, first lateral solid shutter blade 46, second lateral solid shutter blade 48, at least two plates 50 and 52, and bolts 56. In a preferred embodiment, solid shutter assembly 40 comprises plate 50, plate 52, and plate 54. In a preferred embodiment, top solid shutter blade 42 has handle 41, bottom solid shutter blade 44 has handle 43, first lateral solid shutter blade 46 has handle 45, and second lateral solid shutter blade 48 has handle 47. Handle 41, 43, 45, and/or 47 is utilized for manually operating solid shutter assembly 40 when positioned into light system 20, being a manual light system. Top solid shutter blade 42, bottom solid shutter blade 44, first lateral solid shutter blade 46, and/or second lateral solid shutter blade 48 block an output of light when positioned manually within solid shutter assembly 40. First translucent shutter assembly 60 comprises top translucent shutter blade 62, bottom translucent shutter blade 64, first and second lateral translucent shutter blades 66 and 68, at least two plates 70 and 72, and bolts 76. In a preferred embodiment, translucent shutter assembly 60 comprises plate 70, plate 72, and plate 74.

Figure 4:
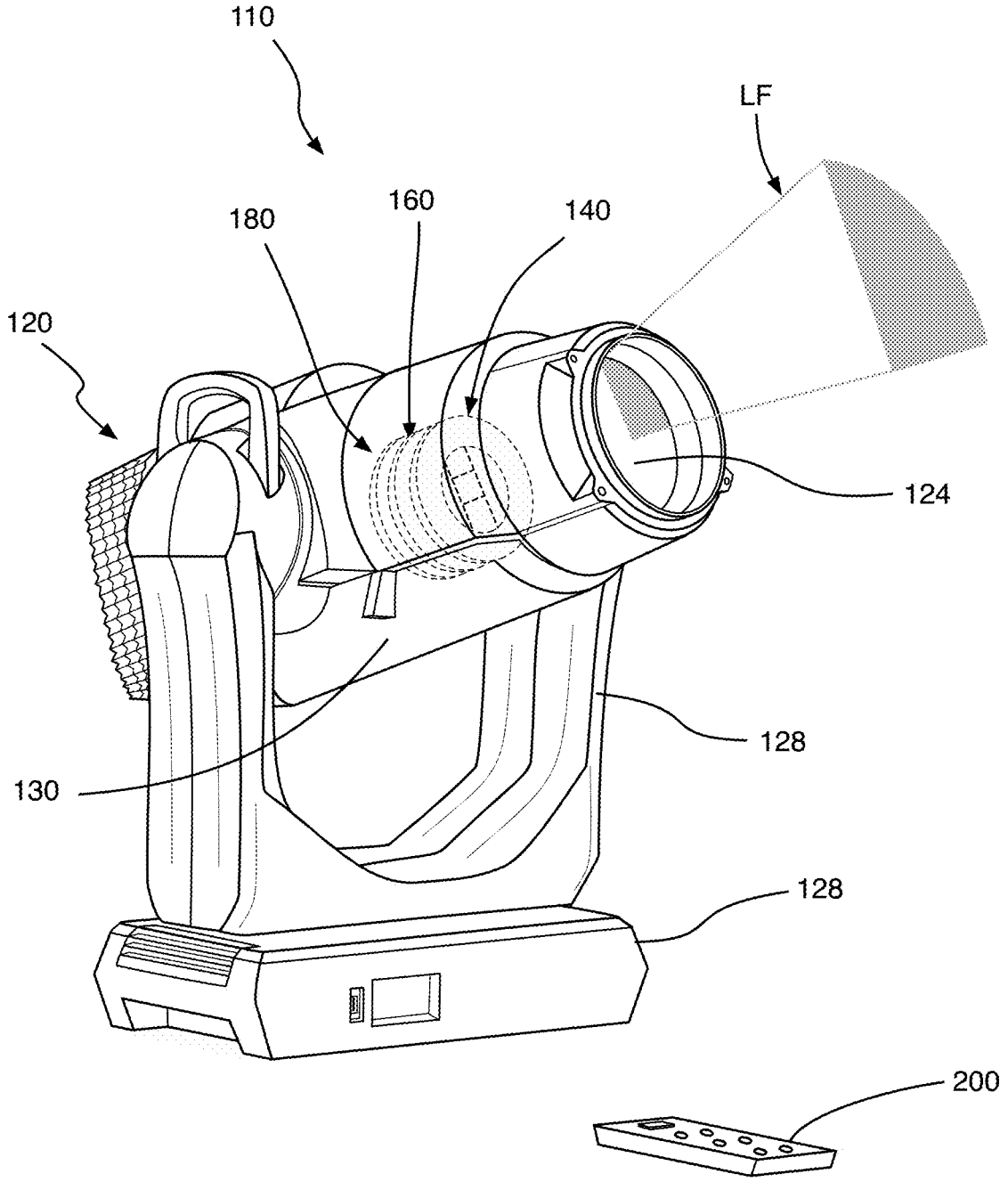
FIG. 4 is an isometric view of a second embodiment of the present invention mounted into an automated lighting system.

In a preferred embodiment, top translucent shutter blade 62 has handle 61, bottom translucent shutter blade 64 has handle 63, first lateral translucent shutter blade 66 has handle 65, and second lateral translucent shutter blade 68 has handle 67. Handle 61, 63, 65, and/or 67 is utilized for manually operating translucent shutter assembly 60 when positioned into light system 20, being a manual light system. Top translucent shutter blade 62, bottom translucent shutter blade 64, and first and second lateral translucent shutter blades 66 and 68 are movable and are used one at a time, or in combination with one another. First translucent shutter assembly 60 allows some light to pass through top translucent shutter blade 62, bottom translucent shutter blade 64, first lateral translucent shutter blade 66, and/or second lateral translucent shutter blade 68. In addition, first translucent shutter assembly 60 also reduces an output in part of a projected light field LF, seen in FIG. 4. Thus, reducing an output solely where top translucent shutter blade 62, bottom translucent shutter blade 64, first lateral translucent shutter blade 66, and/or second lateral translucent shutter blade 68 enters the projected light field LF, while not dimming or reducing the light output of a remaining area of the projected light field LF, as seen in FIG. 4.

Second translucent shutter assembly 80 comprises top translucent shutter blade 82, bottom translucent shutter blade 84, first and second lateral translucent shutter blades 86 and 88, at least two plates 90 and 92, and bolts 96. In a preferred embodiment, translucent shutter assembly 80 comprises plate 90, plate 92, and plate 94. In a preferred embodiment, top translucent shutter blade 82 has handle 81, bottom translucent shutter blade 84 has handle 83, first lateral translucent shutter blade 86 has handle 85, and second lateral translucent shutter blade 88 has handle 87. Handle 81, 83, 85, and/or 87 is utilized for manually operating translucent shutter assembly 80 when positioned into light system 20, being a manual light system. Top translucent shutter blade 82, bottom translucent shutter blade 84, and first and second lateral translucent shutter blades 86 and 88 are movable and are used one at a time, or in combination with one another. Second translucent shutter assembly 80 allows some light to pass through top translucent shutter blade 82, bottom translucent shutter blade 84, first lateral translucent shutter blade 86, and/or second lateral translucent shutter blade 88. In addition, second translucent shutter assembly 80 also reduces an output in part of a projected light field LF, seen in FIG. 4. Thus, reducing an output solely where top translucent shutter blade 82, bottom translucent shutter blade 84, first lateral translucent shutter blade 86, and/or second lateral translucent shutter blade 88 enters the projected light field LF, while not dimming or reducing the light output of a remaining area of the projected light field LF, as seen in FIG. 4.

First translucent shutter assembly 60 comprises a first degree of translucency and second translucent shutter assembly 80 comprises a second degree of translucency. The first degree of translucency and the second degree of translucency are the same or different. In a preferred embodiment, top translucent shutter blades 62 and 82, bottom translucent shutter blades 64 and 84, and lateral translucent shutter blades 66, 68, 86 and 88 can be of a neutral density material or of a diffusion material, such as opal or other materials having similar characteristics.

Figure 3A:
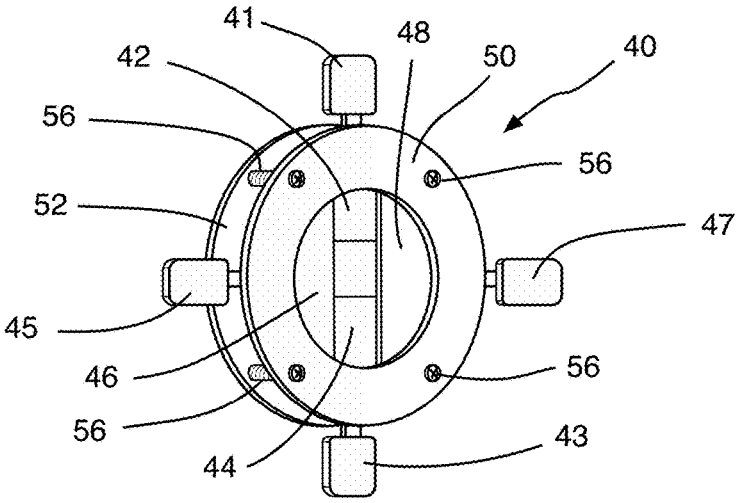
FIG. 3A is an isometric view of a conventional shutter assembly.
Figure 3B:
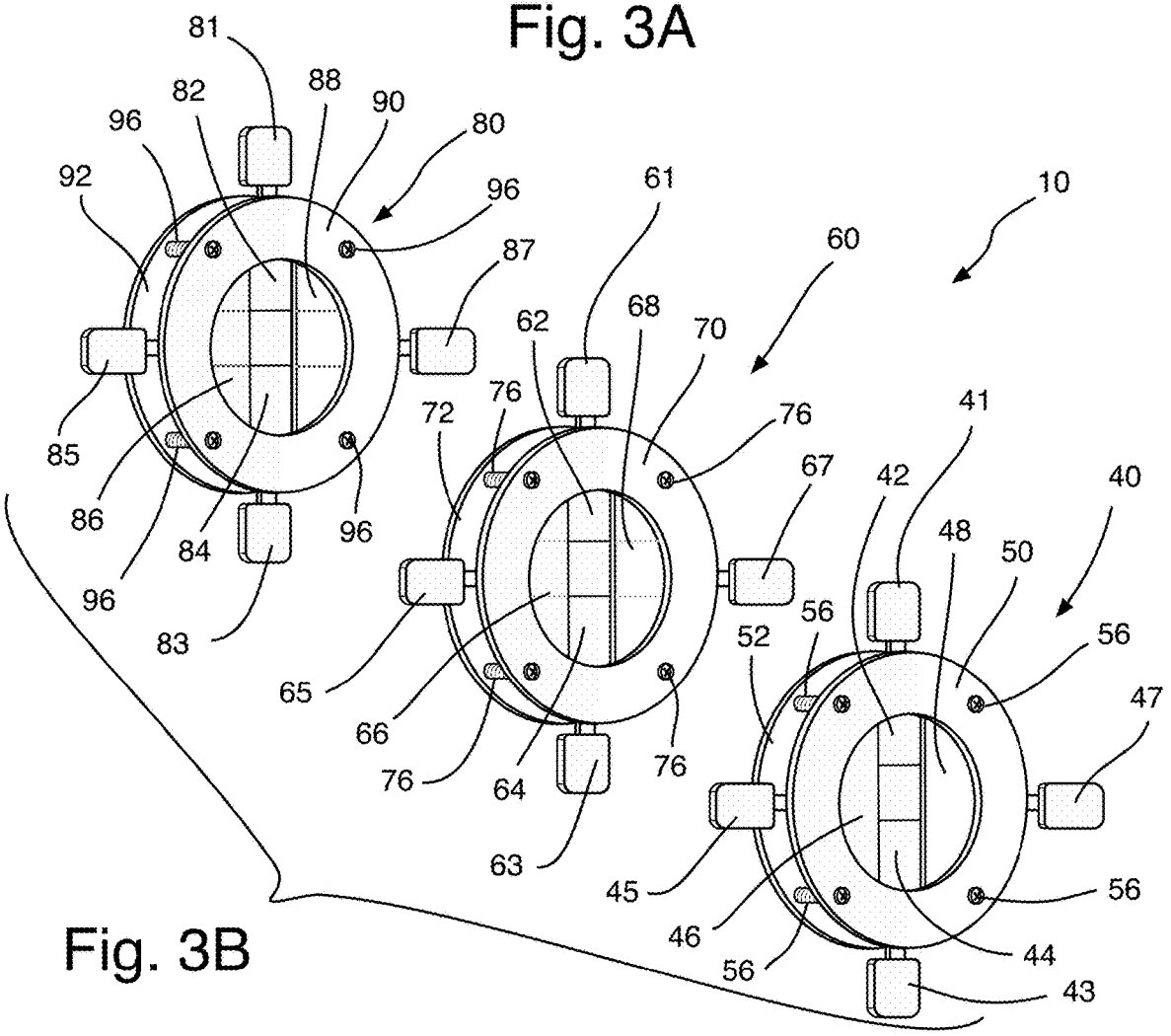
FIG. 3B is an isometric view of the first embodiment of the present invention illustrating the shutter assemblies assembled.

As seen in FIGS. 3A and 3B, solid shutter assembly 40 is assembled, whereby plates 50 and 52, and plate 54 seen in FIG. 2, are assembled facing each other. Solid shutter assembly 40 is assembled with bolts 56, and plates 50, 52, and 54 are separated a predetermined distance from each other to receive top solid shutter blade 42, bottom solid shutter blade 44, first lateral solid shutter blade 46, and second lateral solid shutter blade 48 between them. Handles 41, 43, 45, and 47 extend outwardly from plates 50 and 52.

As seen in FIG. 3B, first translucent shutter assembly 60 is assembled, whereby plates 70 and 72, and plate 74 seen in FIG. 2, are assembled facing each other. First translucent shutter assembly 60 is assembled with bolts 76, and plates 70, 72, and 74 are separated a predetermined distance from each other to receive top translucent shutter blade 62, bottom translucent shutter blade 64, first lateral translucent shutter blade 66, and second lateral translucent shutter blade 68 between them. Handles 61, 63, 65, and 67 extend outwardly from plates 70 and 72.

Second translucent shutter assembly 80 is assembled, whereby plates 90 and 92, and plate 94 seen in FIG. 2, are assembled facing each other. Second translucent shutter assembly 80 is assembled with bolts 96, and plates 90, 92, and 94 are separated a predetermined distance from each other to receive top translucent shutter blade 82, bottom translucent shutter blade 84, first lateral translucent shutter blade 86, and second lateral translucent shutter blade 88 between them. Handles 81, 83, 85, and 87 extend outwardly from plates 90 and 92.

Present invention 10 gives lighting designers additional tools such as focus options that enable fine-tuning to achieve desired lighting goals. Translucent shutter assemblies 60 and 80 are used in conjunction with original/standard solid shutter assembly 40. Solid shutter assembly 40 provides framing for subject(s) being focused on. In operation, translucent shutter assemblies 60 and 80 can be used as follows:

a) In a Back Light Scenario:

(1) By using a Top Cut, translucent shutter assembly 60 and/or translucent shutter assembly 80 can be used to reduce an intensity of light on an individual with either a receding hair line or bald/balding head, thus reducing shine while maintaining a full light output on the individual's shoulders thus maintaining separation from subject to background.

(2) The same Top Cut can be used for individuals with white or blonde hair that often times are over exposed on camera, especially when wearing dark tops.

(3) The reverse (Bottom Cut) can be used when a wardrobe is of a bright or white color and/or of a silky material. This is more evident when skin tones are darker. By reducing an amount of light on the wardrobe, it prevents over exposure on the shoulders.

b) In a Front Light (Key, Fill, Etc.,) Scenario:

(1) Similar to the back light scenario, a Bottom Cut approach can be used when a wardrobe is of a bright color and or of a silky reflective material. This is more evident when skin tones are darker. By removing some intensity from the bright top being worn, it allows the individual's face to pop, and not be diminished when iris adjustments are made.

Figure 7:
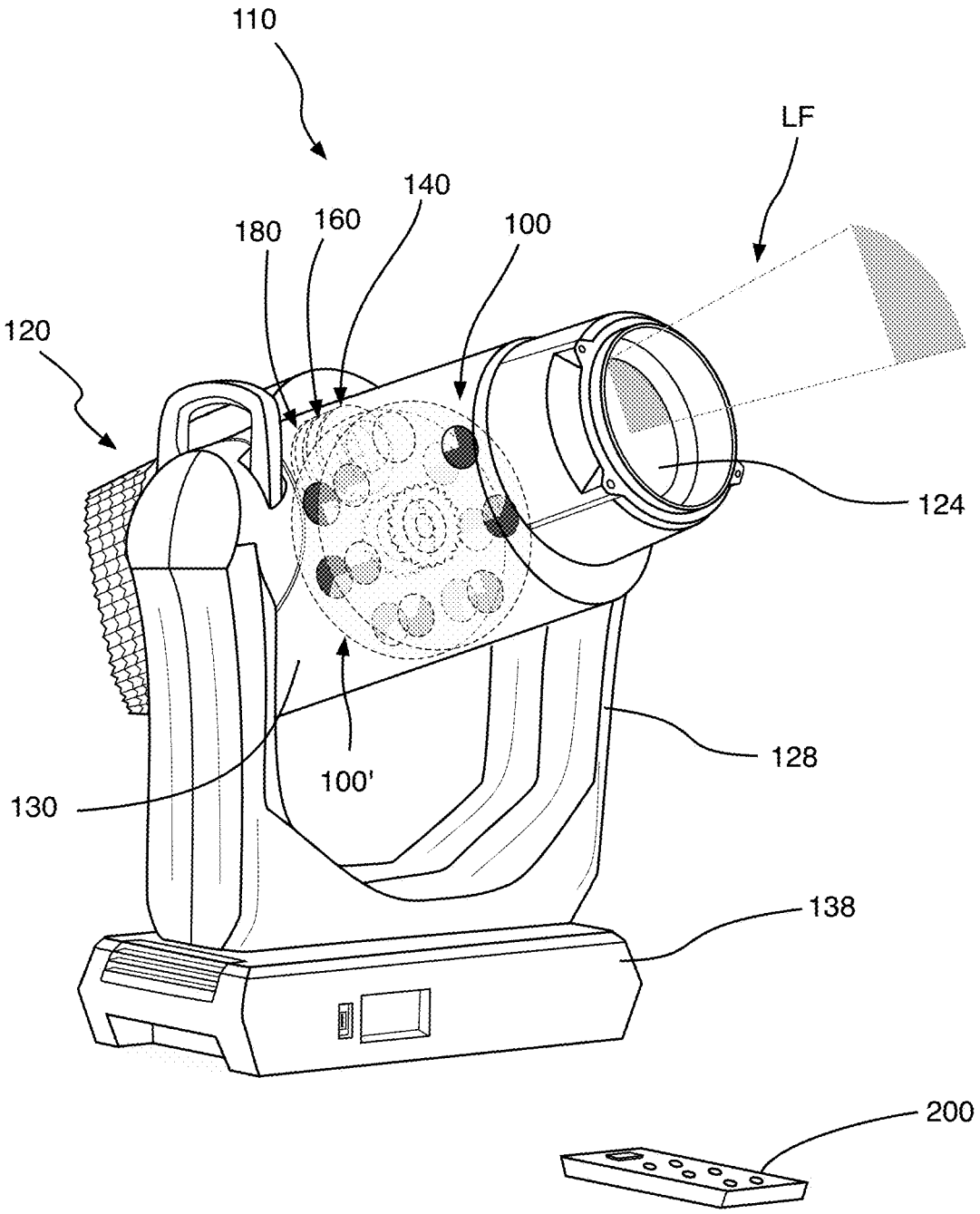
FIG. 7 is an isometric view of a third embodiment of the present invention mounted into an automated lighting system.

(2) When focusing on two individuals, depending on the angle, a side cut can be used to reduce the amount of light on one of the individuals to act as a Fill Light, while maintaining full output on the other individual as a Key Light function. Top and/or bottom cuts can be used in conjunction.

c) In a Theater Focus Scenario:

(1) A typical Theater focus consists of layers being cross-focused from left and right. When a performer enters in an overlapping zone, intensity increases. By using translucent shutter assembly 60 and/or translucent shutter assembly 80, an overlapping area can be reduced for a consistent level throughout the focus.

d) In a Scenic Treatment Scenario:

(1) When focusing/projecting on a scenic element (wall, column, etc.), using translucent shutter assembly 60 and/or translucent shutter assembly 80 enables gradation opportunities used with or without gobos 100, seen in FIG. 7, adding to depth and texture creations.

Seen in FIG. 4 is another embodiment, referred to as present invention 110, comprising first and second translucent shutter assemblies 160 and 180, in combination with solid shutter assembly 140 used on automated lighting system 120. Automated lighting system 120 comprises lens 124, bracket 128, and base 138. Solid shutter assembly 140, first translucent shutter assembly 160, and second translucent shutter assembly 180 are internally incorporated within shutter barrel assembly 130, and is controlled via lighting controller device 200. Solid shutter assembly 140, first translucent shutter assembly 160, and second translucent shutter assembly 180 are sufficiently close to each other to be in a same focal plane so that their respective edges can be in a same focus range when light is projected from automated lighting system 120.

Figure 5:
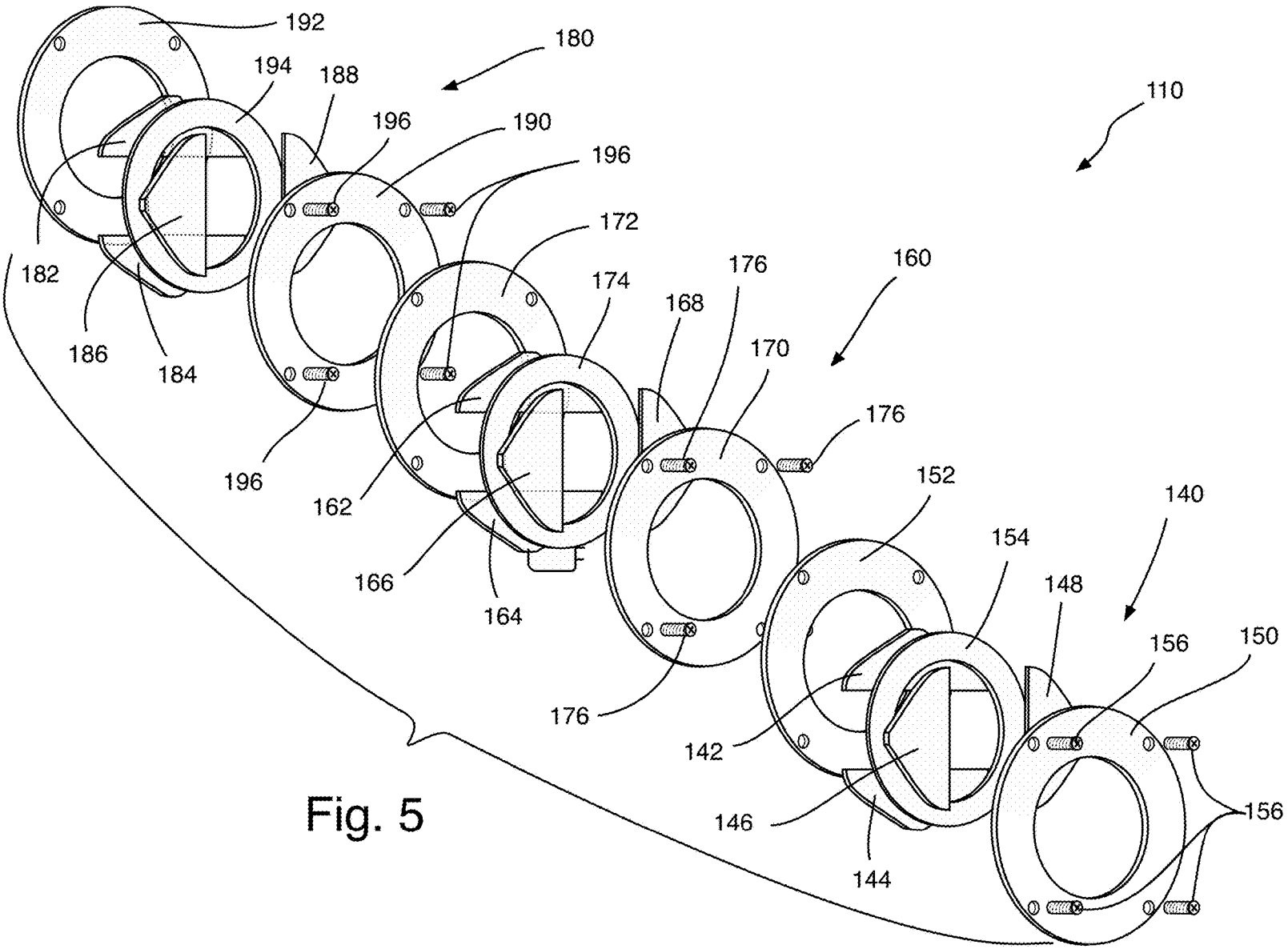
FIG. 5 is an exploded view of the second embodiment of the shutter assemblies of the present invention.

As seen in FIG. 5, solid shutter assembly 140 comprises top solid shutter blade 142, bottom solid shutter blade 144, first lateral solid shutter blade 146, second lateral solid shutter blade 148, at least two plates 150 and 152, and bolts 156. In a preferred embodiment, solid shutter assembly 140 comprises plate 150, plate 152, and plate 154. Top solid shutter blade 142, bottom solid shutter blade 144, first lateral solid shutter blade 146, and second lateral solid shutter blade 148 block an output of light being projected from automated light system 120.

First translucent shutter assembly 160 comprises top translucent shutter blade 162, bottom translucent shutter blade 164, first and second lateral translucent shutter blades 166 and 168, at least two plates 170 and 172, and bolts 176. In a preferred embodiment, translucent shutter assembly 160 comprises plate 170, plate 172, and plate 174. Top translucent shutter blade 162, bottom translucent shutter blade 164, first lateral translucent shutter blade 166, and second lateral translucent shutter blade 168 automatically move and are used one at a time or in combination with one another.

First translucent shutter assembly 160 allows some light to pass through top translucent shutter blade 162, bottom translucent shutter blade 164, first lateral translucent shutter blade 166, and/or second lateral translucent shutter blade 168. In addition, first translucent shutter assembly 160 also reduces an output in part of a projected light field LF, seen in FIG. 4. Thus, reducing an output solely where top translucent shutter blade 162, bottom translucent shutter blade 164, first lateral translucent shutter blade 166, and/or second lateral translucent shutter blade 168 enters the projected light field LF, while not dimming or reducing the light output of a remaining area of the projected light field LF, as seen in FIG. 4.

Second translucent shutter assembly 180 comprises top translucent shutter blade 182, bottom translucent shutter blade 184, first and second lateral translucent shutter blades 186 and 188, at least two plates 190 and 192, and bolts 196. In a preferred embodiment, translucent shutter assembly 180 comprises plate 190, plate 192, and plate 194. Top translucent shutter blade 182, bottom translucent shutter blade 184, first lateral translucent shutter blade 186, and second lateral translucent shutter blade 188 are automatically controlled and are used one at a time or in combination with one another.

Second translucent shutter assembly 180 allows some light to pass through top translucent shutter blade 182, bottom translucent shutter blade 184, first lateral translucent shutter blade 186, and/or second lateral translucent shutter blade 188. In addition, second translucent shutter assembly 180 also reduces an output in part of a projected light field LF, seen in FIG. 4. Thus, reducing an output solely where top translucent shutter blade 182, bottom translucent shutter blade 184, first lateral translucent shutter blade 186, and/or second lateral translucent shutter blade 188 enters the projected light field LF, while not dimming or reducing the light output of a remaining area of the projected light field LF, as seen in FIG. 4.

First translucent shutter assembly 160 comprises a first degree of translucency and second translucent shutter assembly 180 comprises a second degree of translucency. The first degree of translucency and the second degree of translucency are the same or different. In a preferred embodiment, top translucent shutter blades 162 and 182, bottom translucent shutter blades 164 and 184, and lateral translucent shutter blades 166, 168, 186 and 188 can be of a neutral density material or of a diffusion material, such as opal or other materials having similar characteristics.

Figure 6A:
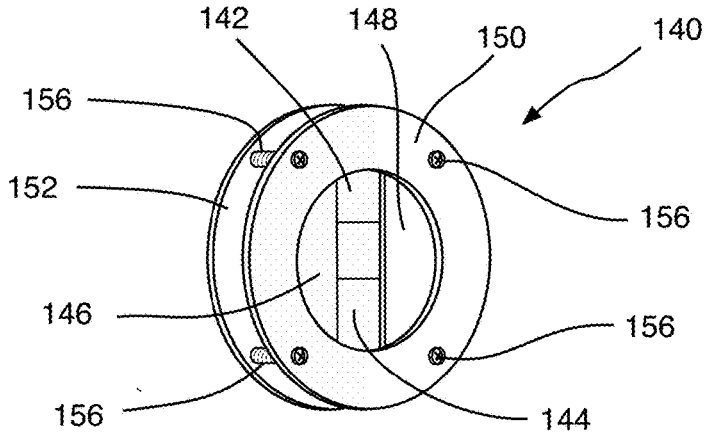
FIG. 6A is an isometric view of a conventional shutter assembly.
Figure 6B:
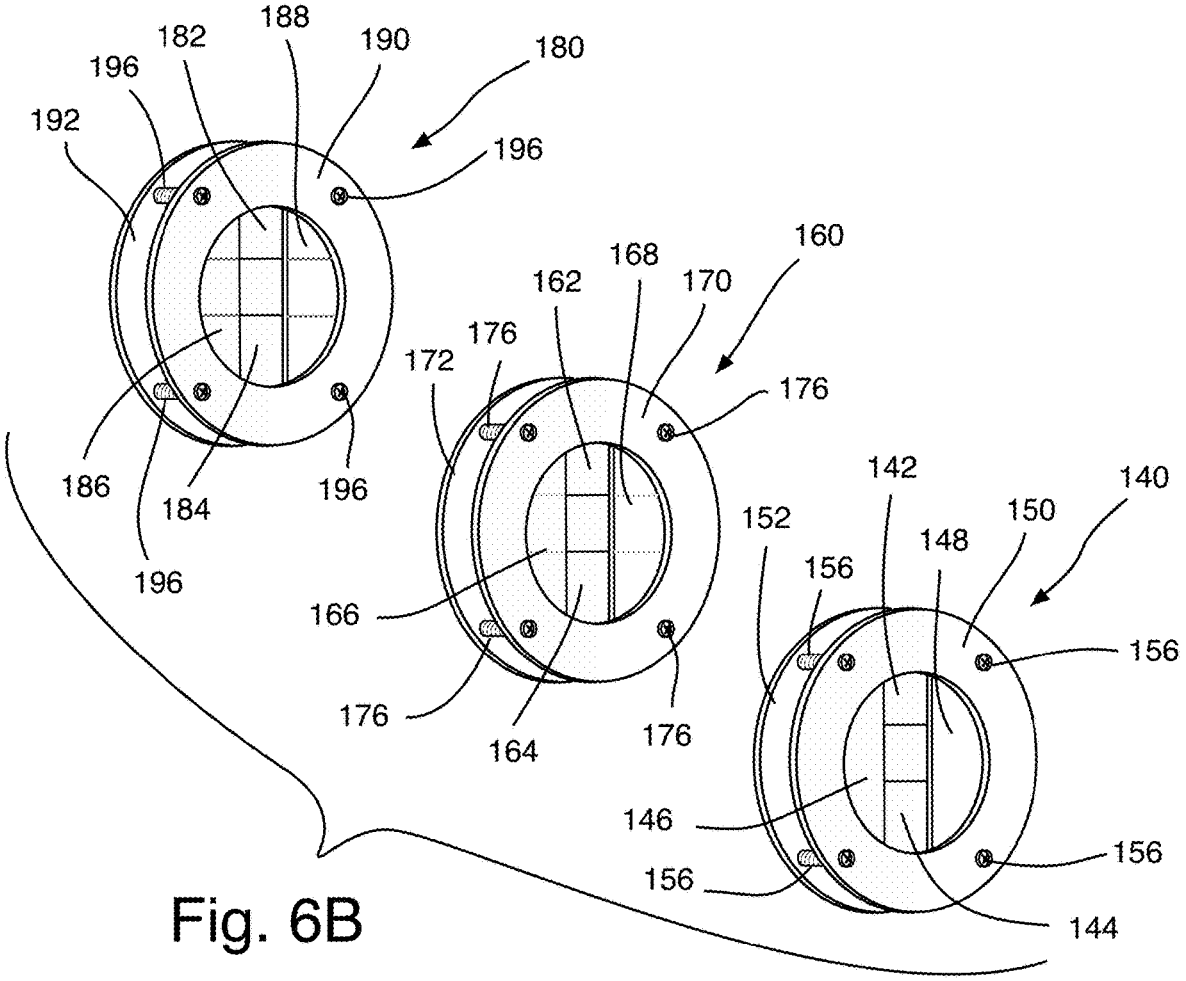
FIG. 6B is an isometric view of the second embodiment of the present invention illustrating the shutter assemblies assembled.

As seen in FIGS. 6A and 6B, solid shutter assembly 140 is assembled, whereby plates 150 and 152, and plate 154 seen in FIG. 5, are assembled facing each other. Solid shutter assembly 140 is assembled with bolts 156, and plates 150, 152, and 154 are separated a predetermined distance from each other to receive top solid shutter blade 142, bottom solid shutter blade 144, first lateral solid shutter blade 146, and second lateral solid shutter blade 148 between them.

As seen in FIG. 6B, first translucent shutter assembly 160 is assembled, whereby plates 170 and 172, and plate 174, seen in FIG. 5, are assembled facing each other. First translucent shutter assembly 160 is assembled with bolts 176, and plates 170, 172, and 174 are separated a predetermined distance from each other to receive top translucent shutter blade 162, bottom translucent shutter blade 164, first lateral translucent shutter blade 166, and second lateral translucent shutter blade 168 between them. Second translucent shutter assembly 180 is assembled, whereby plates 190 and 192, and plate 194, seen in FIG. 5, are assembled facing each other. Second translucent shutter assembly 180 is assembled with bolts 196, and plates 190, 192, and 194 are separated a predetermined distance from each other to receive top translucent shutter blade 182, bottom translucent shutter blade 184, first lateral translucent shutter blade 186, and second lateral translucent shutter blade 188 between them.

Figure 8:
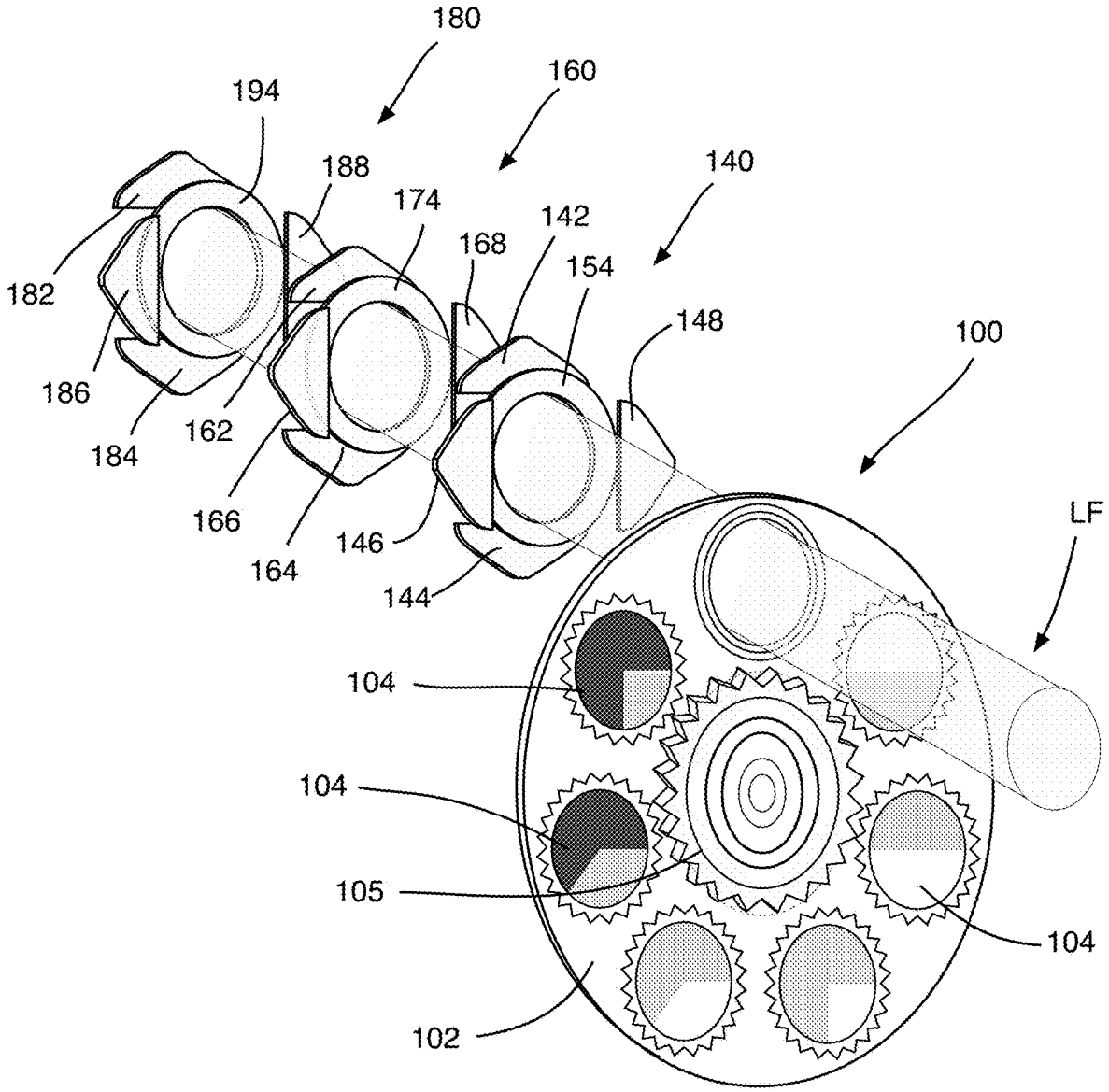
FIG. 8 is an isometric view of the third embodiment of the present invention having shutter assemblies and a Gobo.

As seen in FIGS. 7 and 8, automated lighting system 120 may further comprises at least one gobo wheel 100 in addition to solid shutter assembly 140, first translucent shutter assembly 160, and second translucent shutter assembly 180. At least one gobo wheel 100 can be fixed or rotatably mounted within automated lighting system 120. In a preferred embodiment, automated lighting system 120 comprises first gobo wheel 100 and second gobo wheel 100'. Gobo wheel 100 may be used independently, in conjunction with second gobo wheel 100', and/or in conjunction with solid shutter assembly 140, first translucent shutter assembly 160, and second translucent shutter assembly 180.

Figure 9A:
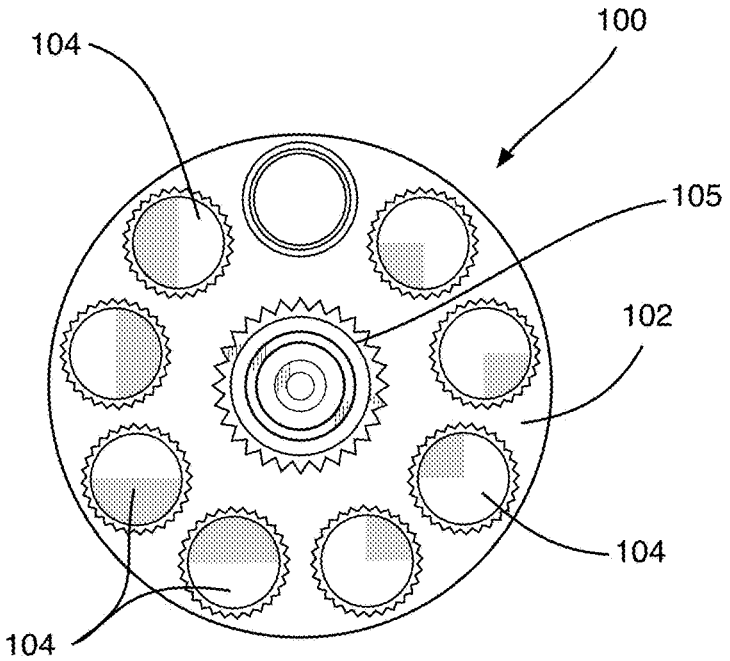
FIG. 9A is a front view of a first embodiment Gobo of the present invention.
Figure 9B:
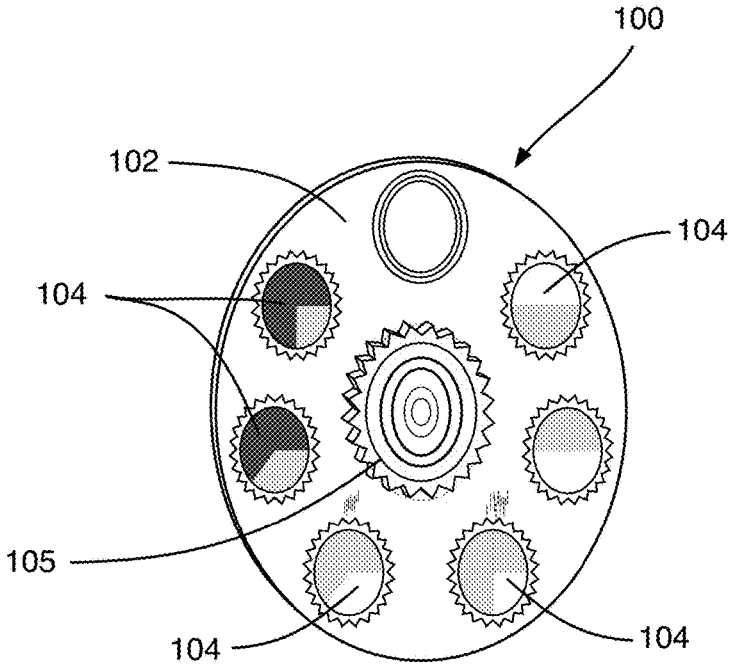
FIG. 9B is an isometric view of a second embodiment Gobo of the present invention.

As seen in FIGS. 9A and 9B, gobo wheel 100 comprises plate 102, gobo patterns 104, and drive gear 105. In a preferred embodiment, gobo wheel 100 comprises a plurality of gobo patterns 104. Gobo patterns 104 may be solid(s) or translucent, whereby the degree of translucency may be the same or different. When gobo patterns 104 are solid or partially solid, cuts may be added with a solid portion similar to solid shutter assembly 140, seen in FIG. 7. When rotated, gobo wheel 100 can be placed in a desired position to select an area where the output will be removed. When gobo patterns 104 are translucent, they may reduce a part of an output of light in a part of the projected light field LF. When rotated, gobo wheel 100 can be placed in a desired position to select the area where the output will be reduced.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A light output reducing shutter system, comprising:

A) a light system having a shutter barrel assembly;

B) a solid shutter assembly;

C) a first translucent shutter assembly; and

D) a second translucent shutter assembly, wherein said solid shutter assembly, said first translucent shutter assembly, and said second translucent shutter assembly are positioned in a same focal plane when a light is projected from said light system.

2. The light output reducing shutter system set forth in claim 1, wherein said first translucent shutter assembly comprises a first degree of translucency and said second translucent shutter assembly comprises a second degree of translucency.

3. The light output reducing shutter system set forth in claim 1, wherein said shutter barrel assembly comprises a first set of slots, a second set of slots, and a third set of slots to receive said solid shutter assembly, said first translucent shutter assembly, and said second translucent shutter assembly respectively.

4. The light output reducing shutter system set forth in claim 3, wherein said first set of slots, said second set of slots, and said third set of slots each comprises four slots around said shutter barrel assembly.

5. The light output reducing shutter system set forth in claim 1, wherein said solid shutter assembly comprises a top solid shutter blade, a bottom solid shutter blade, first and second lateral solid shutter blades, and at least two plates.

6. The light output reducing shutter system set forth in claim 5, wherein said top solid shutter blade, said bottom solid shutter blade, and said first and second lateral solid shutter blades comprise respective handles to be manually operated.

7. The light output reducing shutter system set forth in claim 5, wherein said top solid shutter blade, said bottom solid shutter blade, and said first and second lateral solid shutter blades are internally incorporated within said shutter barrel assembly to be controlled via a lighting controller device.

8. The light output reducing shutter system set forth in claim 1, wherein said first and second translucent shutter assemblies each comprise a top translucent shutter blade, a bottom translucent shutter blade, first and second lateral translucent shutter blades, and at least two plates.

9. The light output reducing shutter system set forth in claim 8, wherein said top translucent shutter blades, said bottom translucent shutter blades, and said first and second lateral translucent shutter blades each comprise a respective handle to be manually operated.

10. The light output reducing shutter system set forth in claim 8, wherein said top translucent shutter blades, said bottom translucent shutter blades, and said first and second lateral translucent shutter blades are internally incorporated within said shutter barrel assembly to be controlled via a lighting controller device.

11. The light output reducing shutter system set forth in claim 8, wherein said top translucent shutter blades, said bottom translucent shutter blades, and said first and second lateral translucent shutter blades are used one at a time or in combination with one another.

12. The light output reducing shutter system set forth in claim 8, wherein said top translucent shutter blades, said bottom translucent shutter blades, and said first and second laterals translucent shutter blades allow some light to pass through them.

13. The light output reducing shutter system set forth in claim 1, wherein at least one of said first translucent shutter assembly and said second translucent shutter assembly is used in combination with said solid shutter assembly.

14. The light output reducing shutter system set forth in claim 1, wherein said first translucent shutter assembly and said second translucent shutter assembly reduce an intensity of said light projected from said light system.

15. The light output reducing shutter system set forth in claim 8, wherein said first translucent shutter assembly and said second translucent shutter assembly reduce an output in part of a projected light field, thus reducing an output solely where said top translucent shutter blades, said bottom translucent shutter blades, said first lateral translucent shutter blades, and/or said second lateral translucent shutter blades enter said projected light field, while not dimming or reducing a light output of a remaining area of said projected light field.

16. The light output reducing shutter system set forth in claim 1, wherein said lighting system is an automated light system.

17. The light output reducing shutter system set forth in claim 1, wherein said lighting system further comprises at least one gobo wheel fixed or rotatably mounted therein.

18. The light output reducing shutter system set forth in claim 17, wherein said at least one gobo wheel is used independently or in combination with said solid shutter assembly and said first and second translucent shutter assemblies.

19. The light output reducing shutter system set forth in claim 17, wherein said at least one gobo wheel comprises a plurality of gobo patterns, whereby said plurality of gobo patterns are solids and/or translucent.

20. The light output reducing shutter system set forth in claim 2, wherein said first degree of translucency and said second degree of translucency are the same or different.

* * * * *